US007188573B2

(12) United States Patent
Hirabara

(10) Patent No.: US 7,188,573 B2
(45) Date of Patent: Mar. 13, 2007

(54) WATER JET PROPULSION WATERCRAFT

(75) Inventor: Yoshiki Hirabara, Hamamatsu (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/085,913

(22) Filed: Mar. 22, 2005

(65) Prior Publication Data

US 2005/0204996 A1 Sep. 22, 2005

(30) Foreign Application Priority Data

Mar. 22, 2004 (JP) ..... 2004-081800

(51) Int. Cl.
*B63B 17/00* (2006.01)

(52) U.S. Cl. ..... 114/55.57; 114/363; 297/196

(58) Field of Classification Search ..... 114/363, 114/55.57, 182, 197, 198; 297/196, 215; 440/38

See application file for complete search history.

(56) References Cited

U.S. PATENT DOCUMENTS 1,205,828 A * 11/1916 Whaley ..... 248/584
2,463,268 A * 3/1949 Handley ..... 248/628
2,474,081 A * 6/1949 Wolf ..... 248/628
2,497,121 A * 2/1950 Fletcher ..... 280/261
3,163,409 A * 12/1964 Running et al. ..... 267/154
3,340,554 A * 9/1967 Allender ..... 441/65
4,660,490 A * 4/1987 Broadhurst ..... 114/61.26
6,145,458 A * 11/2000 Hattori ..... 114/55.57
2004/0154524 A1* 8/2004 Fedders ..... 114/363

FOREIGN PATENT DOCUMENTS

JP A-2000-136000 5/2000

* cited by examiner

*Primary Examiner*—Stephen Avila
(74) *Attorney, Agent, or Firm*—Knobbe, Martens, Olson & Bear, LLP

(57) ABSTRACT

A water jet propulsion watercraft can be provided with: a supporting member that supports a straddle-type seat on a deck thereof. Steering handlebars can be disposed in front of the seat. A space can be formed between the seat and the deck directly underneath the seat, extending approximately over the entire length of the seat in a fore-and-aft direction of the watercraft. The supporting member can have an upper portion secured to the seat, a lower portion secured to the deck, and an intermediate portion connecting the upper portion and the lower portion. The intermediate portion can be provided at either the front end or the rear end of the seat.

7 Claims, 14 Drawing Sheets

WATER JET PROPULSION WATERCRAFT

PRIORITY INFORMATION

This application is based on and claims priority under 35 U.S.C. §119 to Japanese Patent Application No. 2004-081800, filed on Mar. 22, 2004, the entire contents of which is hereby expressly incorporated by reference herein.

BACKGROUND OF THE INVENTIONS

1. Field of the Inventions

The present inventions relate to a watercraft, and in particular, to such watercraft on which an operator can control the handlebar while in a standing position, straddling the seat.

2. Description of the Related Art

Conventional jet propulsion watercraft, such as those commonly referred to as "personal watercraft" typically include concave areas, as viewed from the side, formed in the rear portion of the hull and on both sides of the seat. These recessed areas open toward the rear of the watercraft. In some watercrafts of this type, handgrips are provided on both sides of the concave areas. When an operator in water tries to climb onto the watercraft from the water in which the watercraft is floating, the operator can grab the handgrips and make use of the concave area for climbing up easily. Such a design is illustrated in Japanese Patent Publication No. JP-A-2000-136000, and particularly at pages 1–5 and FIGS. 1–7 thereof.

SUMMARY OF THE INVENTIONS

An aspect of at least one of the embodiments disclosed herein includes the realization that the inclined surface of the seat pedestal of such watercraft can be better utilized for storage. For example, the seats of such watercraft are formed with a seat pedestal that is usually formed from the same generally rigid material as the hull of the watercraft. The pedestal is generally the same shape as the seat in top plan view. However, there can be significant volumes of empty space within the seat pedestal. Additionally, at the rear end of the seat pedestal, an inclined surface extends downwardly from the seat, to the upper surface of the deck. This inclined surface can pose some problems such that the space on the deck directly underneath the rear part of the seat cannot be utilized when an operator in water tries to climb onboard. Additionally, this space cannot be utilized as a storage room for luggage. Thus, by eliminating this rearwardly inclined surface of the seat pedestal, operators can more easily climb aboard such a watercraft and this space can more easily be used for storage.

Thus, in accordance with an embodiment, a watercraft comprises a lower hull, a deck, and a straddle-type seat. A supporting member is configured to support the seat on the deck. A steering handlebar bar is disposed in front of the seat. A space is formed between the seat and the deck directly underneath the seat, extending approximately over the entire length of the seat in fore-and-aft direction of the watercraft. The supporting member has an upper portion secured to the seat, a lower portion secured to the deck, and an intermediate portion connecting the upper portion and the lower portion. Additionally, the intermediate portion is provided at either the front end or the rear end of the seat.

In another embodiment, a watercraft comprises a lower hull, a deck, and a straddle-type seat. A steering handlebar bar is disposed in front of the seat. Support means is also provided for supporting the seat so as to form an empty space occupying substantially the entire space between the seat and the deck directly underneath the seat and extending approximately over the entire length of the seat in fore-and-aft direction of the watercraft.

BRIEF DESCRIPTION OF THE DRAWINGS

These and other features and advantages of the inventions, features, aspects, and embodiments will become more apparent upon reading the following detailed description and with reference to the accompanying drawings of an embodiment that exemplifies the invention. The drawings comprise the following figures.

DETAILED DESCRIPTION OF THE PREFERRED EMBODIMENTS

Figure 1:
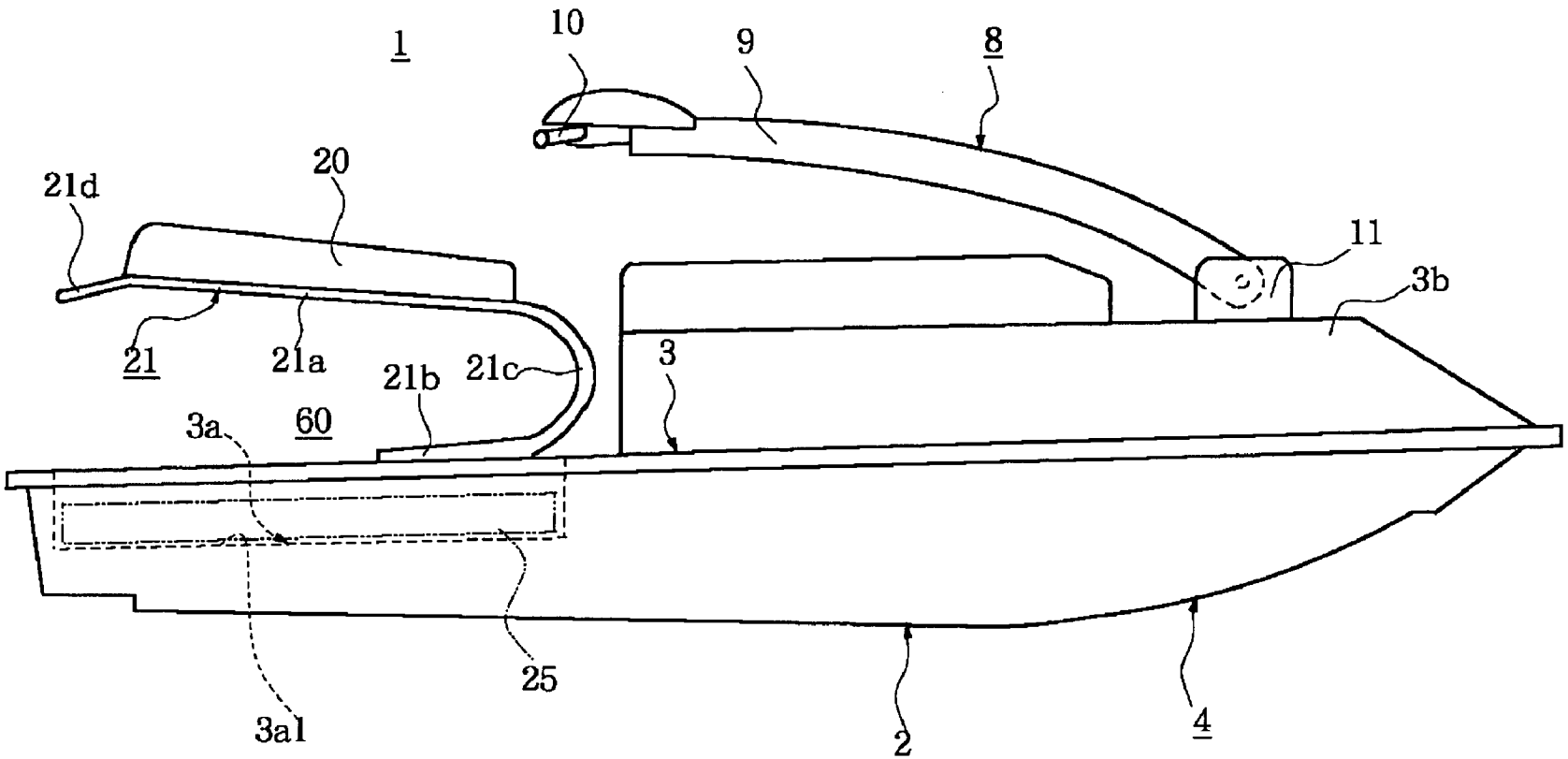
FIG. 1 is a side elevational view of a small watercraft constructed in accordance with an embodiment.

An embodiment is described below with reference to the drawings. FIG. 1 shows a personal water-jet propulsion watercraft 1 constructed in accordance with an embodiment. The embodiments disclosed herein are described in the context of a personal watercraft because these embodiments have particular utility in this context. However, the embodiments and inventions herein can also be applied to other marine vessels, such as and small jet boats, as well as other vehicles.

Figure 3:
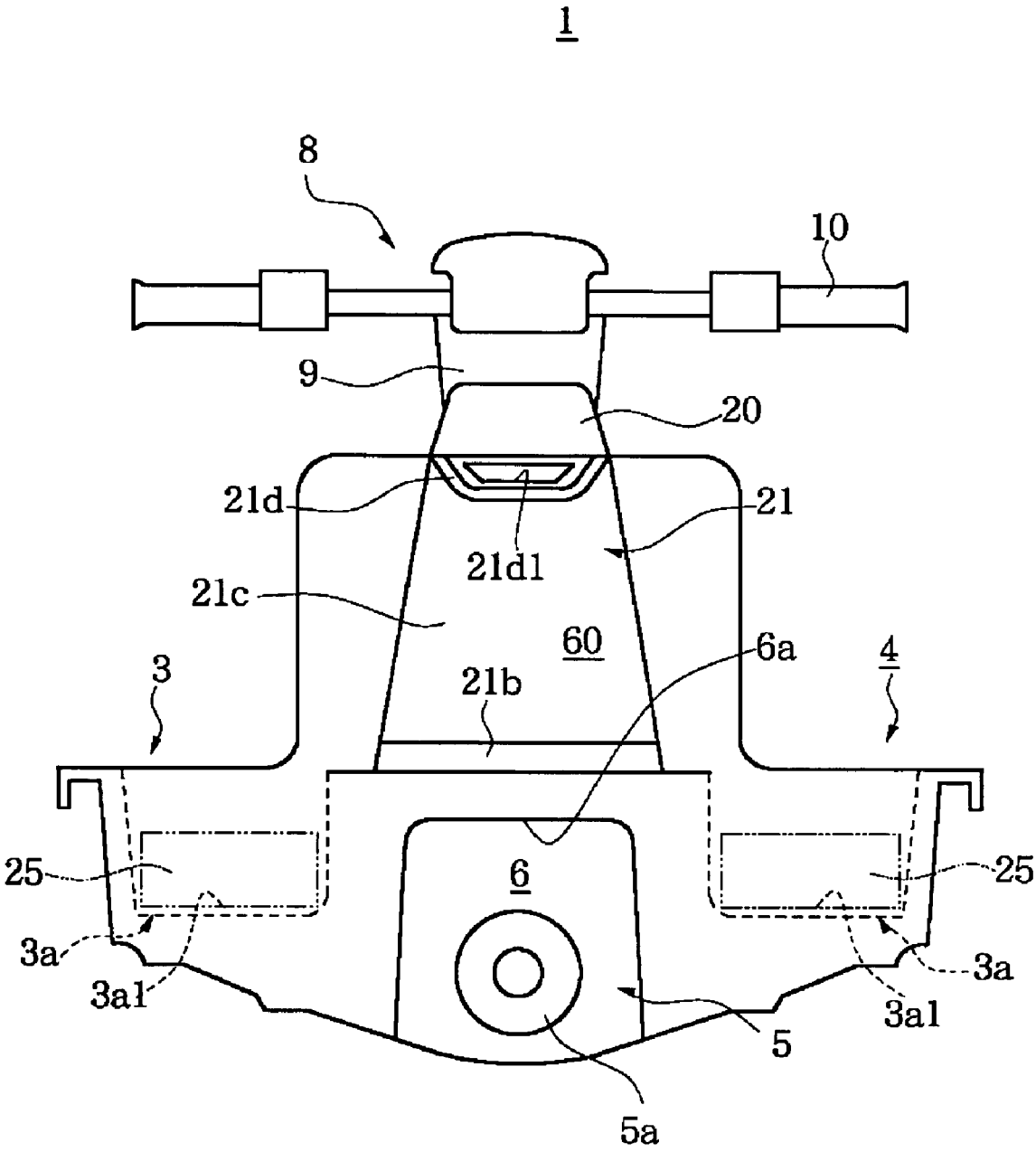
FIG. 3 is a rear elevational view of the watercraft of FIG. 1.

In the watercraft 1 according to this embodiment, a watercraft body 4 is formed by joining a hull 2 and a deck 3 at their peripheries. A nozzle 5*a* of the jet propulsion device 5 located within the watercraft body 4 is positioned in a hull tunnel 6 (FIG. 3).

An engine hatch 7 can be provided on the deck 3. Further, a handlebar device 8 can be supported at the front side area 3*b* of the deck 3.

The handlebar device 8 can include a steering pole 9 and steering handlebars 10. This type of handlebar device is commonly used on modern "stand up" type watercraft. This type of handlebar device provides a further advantage in that it is easy for an operator to operate the watercraft 1 from a seated or standing position. However, this is merely one type of handlebar device that can be used; other types of handlebar devices can also be used.

Figure 4:
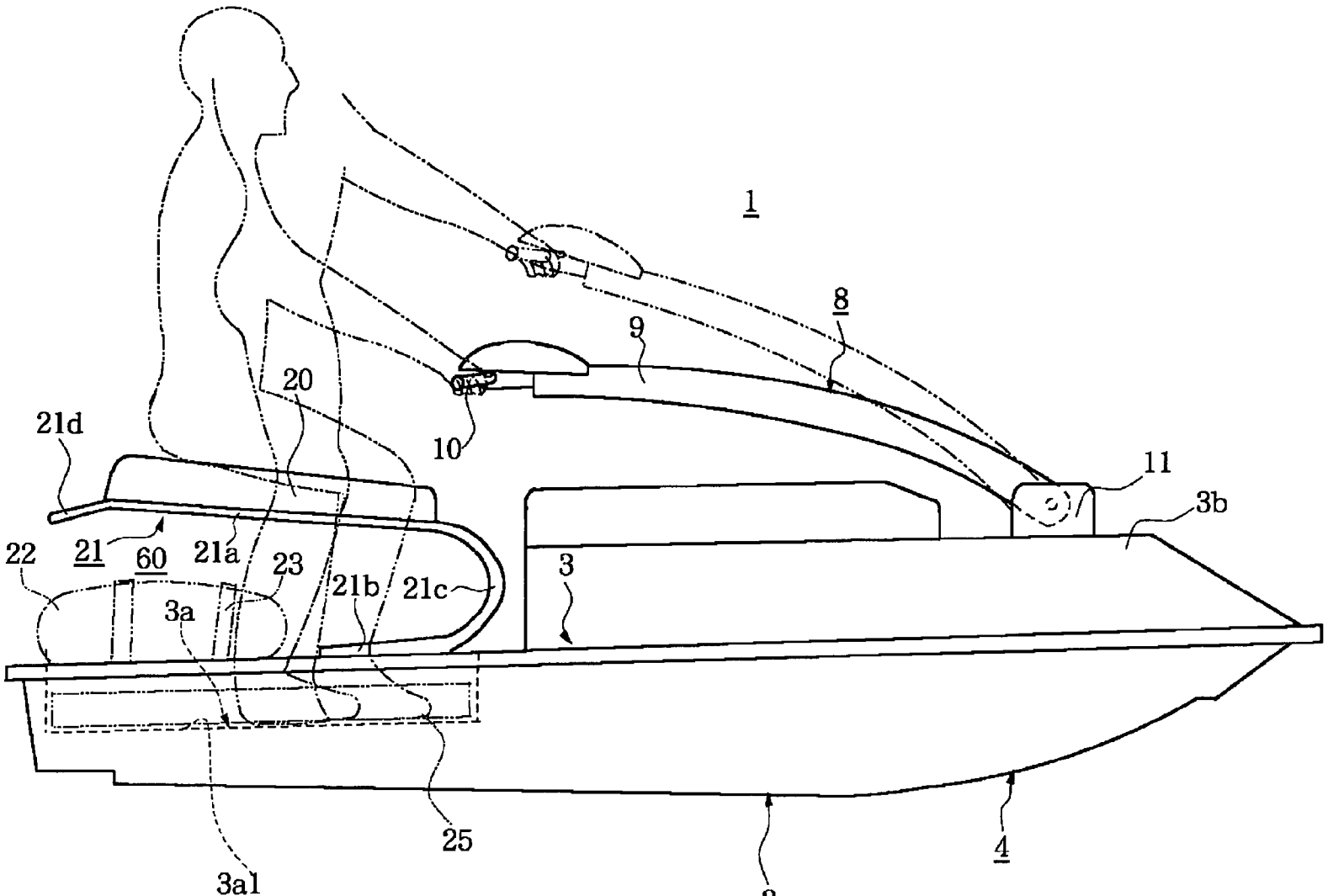
FIG. 4 is side elevational view of the watercraft of FIG. 1 with an operator illustrated in both seated and standing positions and with an article disposed below the seat.

In the illustrated embodiment, the front side of the steering pole 9 can be attached to the front side area 3*b* of the deck 3 via a hinge portion 11. The hinge portion 11 can be configured to allow the pole 9 to rotate or pivot relative to the front side area 3*b* of the deck. The steering handlebars 10 are installed at the rear of the steering pole 9. As shown in FIG. 4, the tilting angle of the steering handlebars 10 is adjustable. With this geometry, the steering handlebars 10, along with the rearward end of the pole 9, can be moved generally vertically in upward and downward directions. This type of steering assembly allows an operator to operate the watercraft 1 from a seated position and from a generally fully-erect standing position.

With continued reference to FIG. 1, a supporting member 21 can be installed on the deck 3 for supporting a seat 20, which can be a straddle-type seat. The supporting member 21 can have an upper portion 21*a* secured to the seat 20, a lower portion 21*b* secured to the deck 3, and an intermediate portion 21*c* connecting the upper portion 21*a* and the lower portion 21*b*. The intermediate portion 21*c* is provided in front of the seat 20. In addition, a handgrip section 21*d* is formed extendedly and slanting downward from the rear of the upper portion 21*a*. A grip opening 21*d*1 is formed on the handgrip section 21*d*.

The supporting member 21 can be constructed from a flat spring member configured to flex generally vertically. The flat spring member can be made of reinforced plastics. However, it is not limited to the reinforced plastics. It may instead be formed with a metal spring.

In the illustrated embodiment, the supporting member 21 generally takes the shape of a letter "C" in the side view. By forming the supporting member 21 generally in the shape of letter "C" in the side view, it is easy to reserve sufficient space 30 between the seat 20 and the deck 3 directly underneath the seat 20, approximately over the entire length of the seat 20 in fore-and-aft direction.

Figure 2:
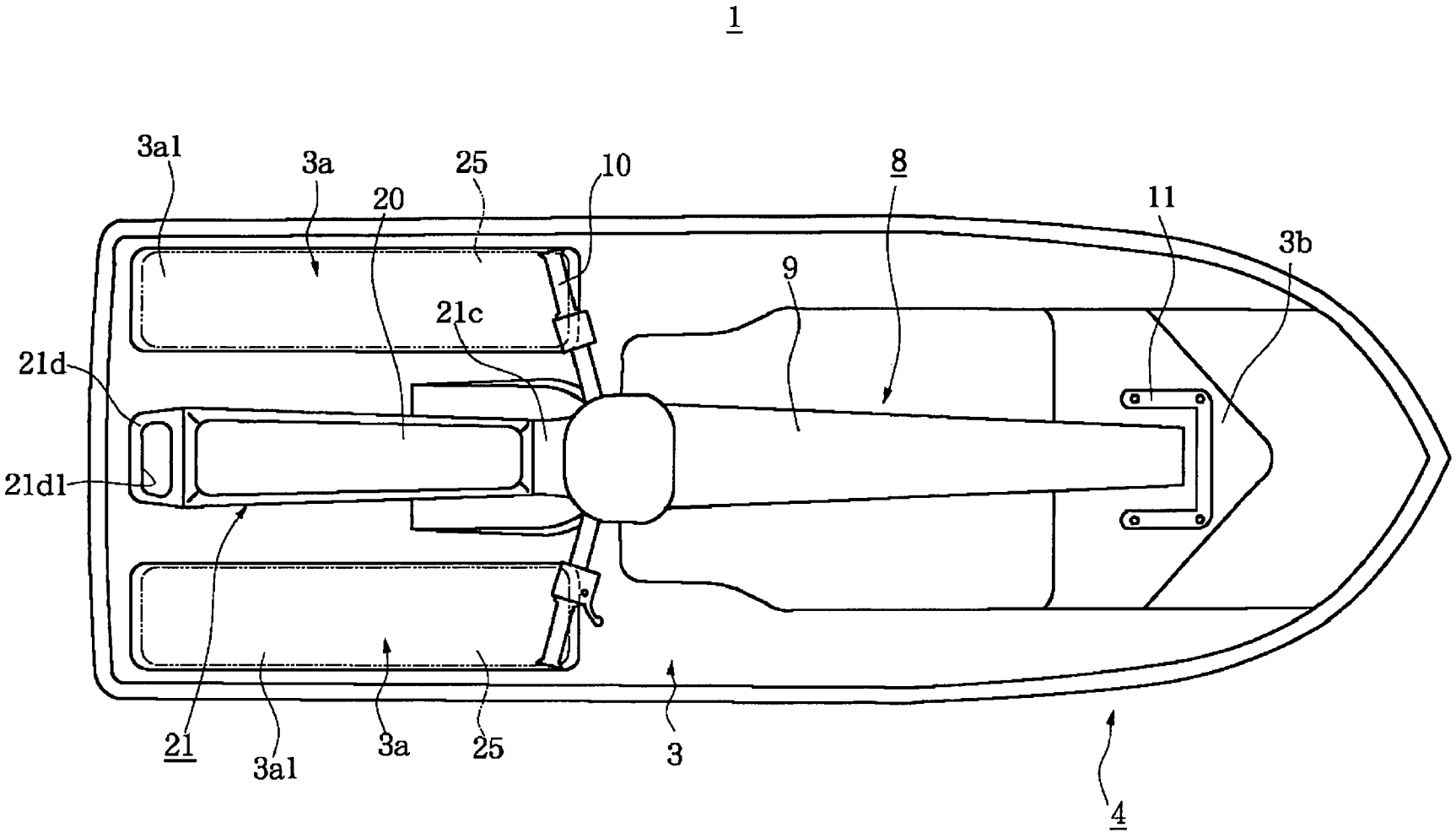
FIG. 2 is a top plan view of the watercraft of FIG. 1.

In the watercraft 1 according to this embodiment, the operator can easily climb aboard by grabbing the grip opening 21*d*1 (FIG. 2) of the handgrip section 21*d*, to reach an operating position shown in FIG. 4. The operator can sit on the seat 20, and can operate the watercraft by manipulating the steering handlebars 10. Also, the operator can operate the watercraft 1 in the standing position by adjusting the tilting angle of the steering handlebars 10. The handlebar device 8 has an advantage allowing wider range of riding position and running style, since the steering handlebars 10 and the handlebar pole 9 are movable in a generally vertical direction.

Further, the watercraft 1 according to this embodiment has the steering handlebars 10 disposed in front of the seat 20, and is provided with the space 30 which is formed between the seat 20 and the deck 3 directly underneath the seat 20 and extending in fore-and-aft direction approximately over the entire length of the supporting member 21. When the operator in the water climbs aboard, the operator can climb easily by grabbing the grip opening 21*d*1 of the handgrip section 21*d*, pulling up his or her upper body onto the space 30. Thus, the area on the deck 3 directly underneath the seat 20 can be utilized effectively as the space for the operator in the water to pull up his or her body on board the watercraft.

In addition, the space 30 can be utilized as a storage area, because the space 30 can accommodate a luggage 22, which can optionally be secured by a belt 23. The water jet propulsion unit 1 can be operated with hard deceleration and sharp turns. Under such circumstances, forward movement of the luggage 22 can be restrained by the intermediate portion 21*c* of the supporting member 21. In this way, the intermediate portion 21*c* can be utilized as a restricting member to stop the movement of the luggage 22.

The supporting member 21 in this embodiment is constituted with a flat spring member flexing vertically. It can adequately absorb the vibration generated while the watercraft is operated, providing a more comfortable riding feeling for the operator. At the same time, the seat 20 is supported firmly with simplified structure containing less number of parts. In addition, the flat spring member made of reinforced plastics forms a seat base making use of the elasticity of reinforced plastics. Thus, the seat base dampens strong impacts that cannot be absorbed by a cushion of the seat 20, and restrains the vibration that has different frequency range from those absorbed by the seat cushion, resulting in greatly improved cushioning against the vibration when the operator sits on the seat.

A recessed area 3*a* for fitting in a foot rest member 25 is provided on each side of the seat 20 on the deck 3. As the foot rest member 25 is fitted in the recessed area 3*a*, it can be provided on both sides of the seat 20. The food rest member 25 can be provided with a predetermined height and arranged so that it can be attached to and/or detached from the deck 3 freely.

The foot rest members 25 can be configured to form interference fits or clearance fits with the recessed areas 3*a*. Optionally, the members 25 can be shaped such that one or more portions of the members 25 form interference fits with the recessed areas 3*a* and one or more other parts form clearance fits. Further, the interference and/or clearance fits can be configured so as to retain the members 25 in the recessed areas during operation of the watercraft 1, yet remain freely removeable such that a human can lift the members 25 out of the recessed areas 3*a* by hand without the need for tools.

By arranging the foot rest member 25 to be freely attachable to and detachable from the deck 3, a tall operator can sit straddling over the seat 20 taking proper posture with the foot rest member 25 is removed, while a short operator can also sit straddling over the seat 20 in proper posture with the foot rest member 25 is installed.

As shown in FIG. 3, the recessed area 3*a* is configured to receive the foot rest member 25 on the deck 3. Additionally, the recessed area 3*a* can be formed so that the upwardly facing surface of the recessed area 3*a* is positioned lower than a top wall 6*a* of the hull tunnel 6. This allows setting the height of the deck 3 in the relevant area as low as practicable when the foot rest member 25 is removed, so as to accommodate taller operators. Consequently, the center of gravity for the watercraft body 4 including the operator is made lower, making the watercraft more stable.

Figure 5:
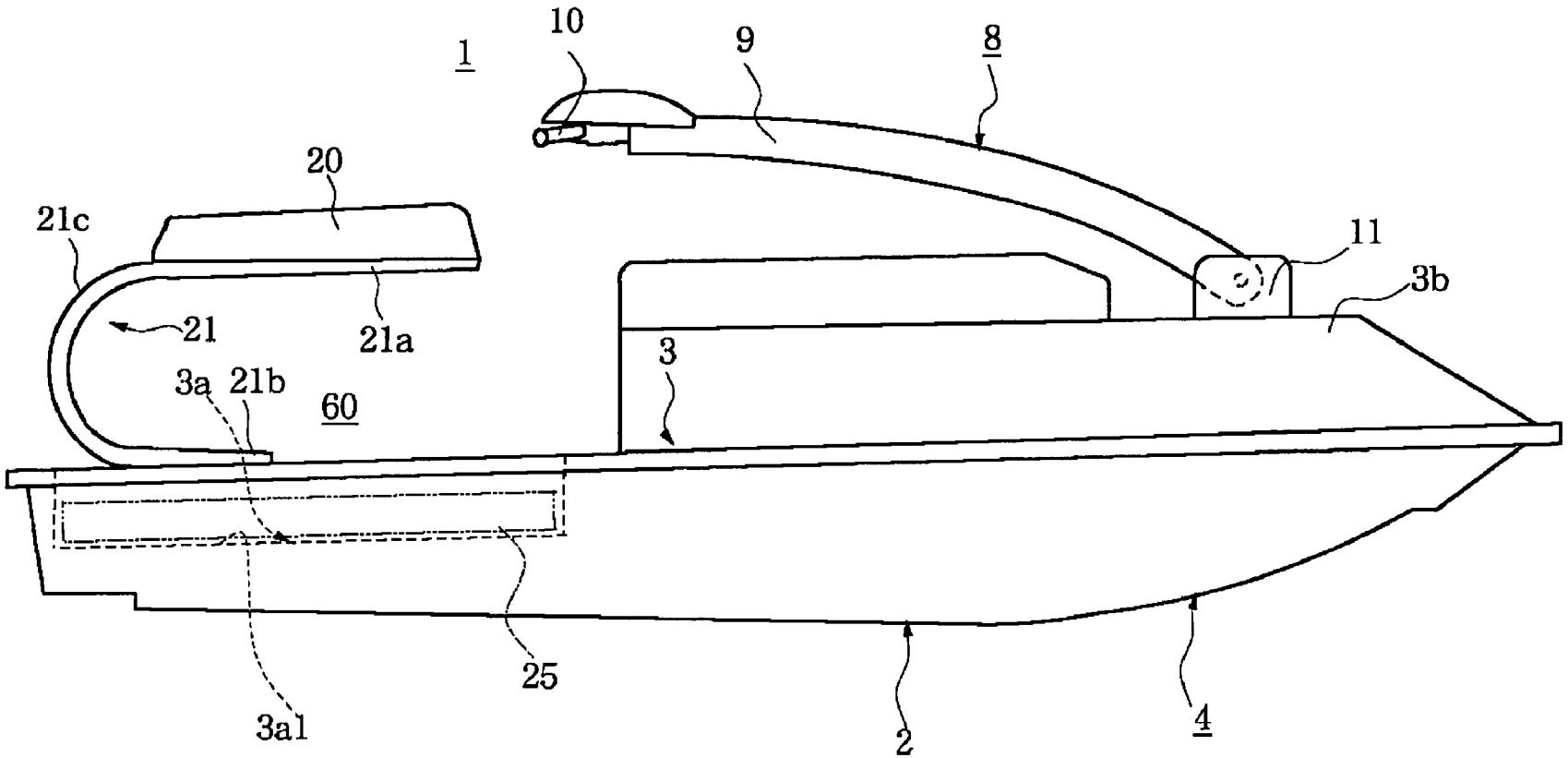
FIG. 5 is a side elevational view of a modification of the small watercraft of FIG. 1.

FIG. 5 illustrates the watercraft 1 with a modified version of the supporting member 21 according to another embodiment. FIG. 5 is a side view of the watercraft 1. The watercraft 1 according to this embodiment is constructed similarly to the embodiment shown in FIGS. 1 through 4, except for the intermediate portion 21*c* of the supporting member 21 being provided on the rear side of the seat 20.

This provides a further advantage in that the watercraft 1 can be operated with sudden start. Under such circumstances, the luggage 22 can move rearward, but will be stopped by the intermediate portion 21*c* of the supporting member 21 such that the movement of the luggage 22 is restrained. In this way, the intermediate portion 21*c* can be utilized as a restricting member to stop the movement of the luggage 22 toward the rearward direction. Also, the intermediate portion 21*c* can be utilized as a handgrip for the operator climbing aboard from the rear of the watercraft when the intermediate portion 21*c* is provided on the rear side of the seat 20.

Figure 6:
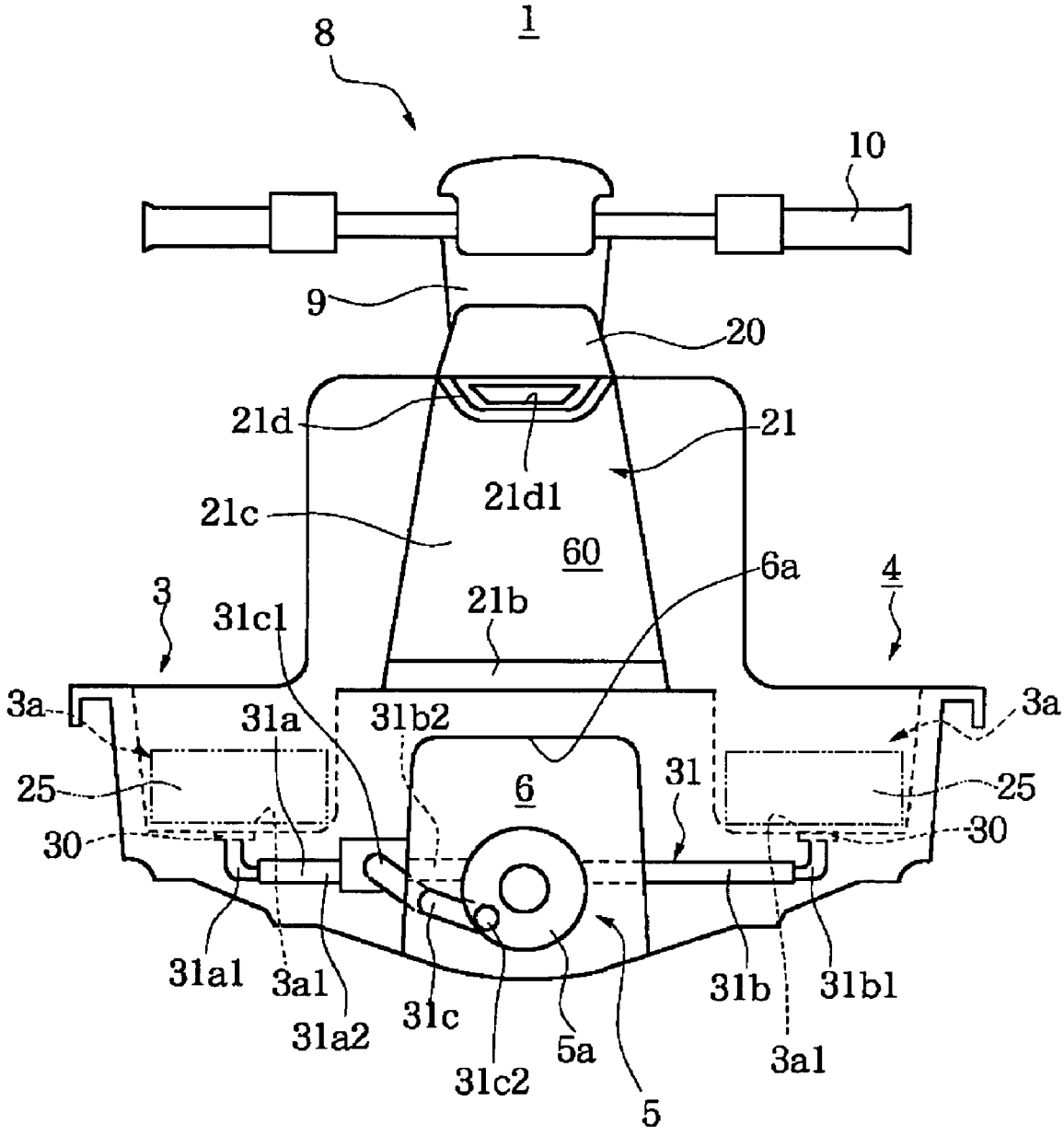
FIG. 6 is a rear elevational view of the watercraft of FIG. 5.
Figure 7:
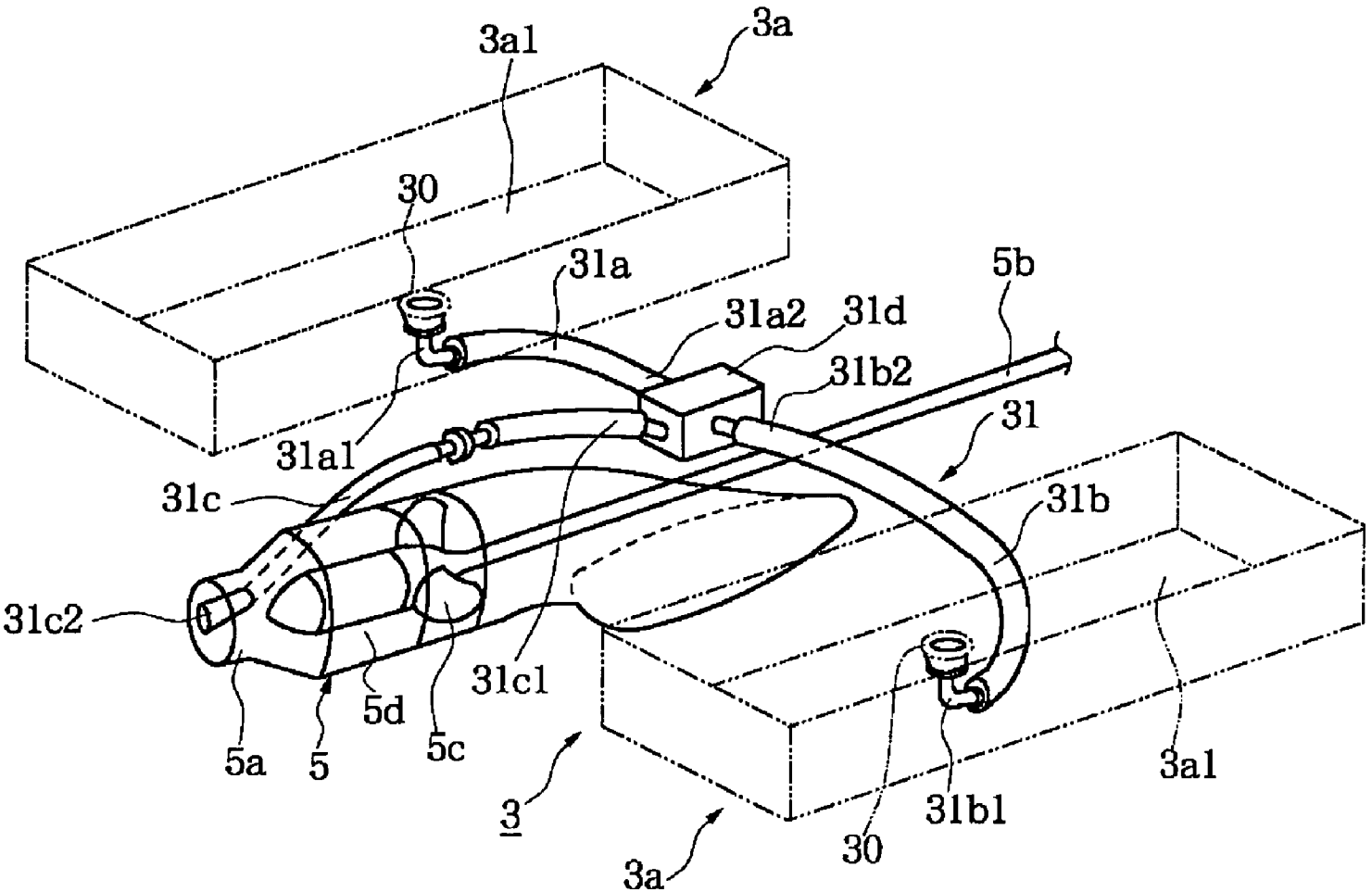
FIG. 7 is an enlarged perspective view of a rear drainage assembly that can be used with the watercraft of FIGS. 1–6 as well as other watercraft.
Figure 8:
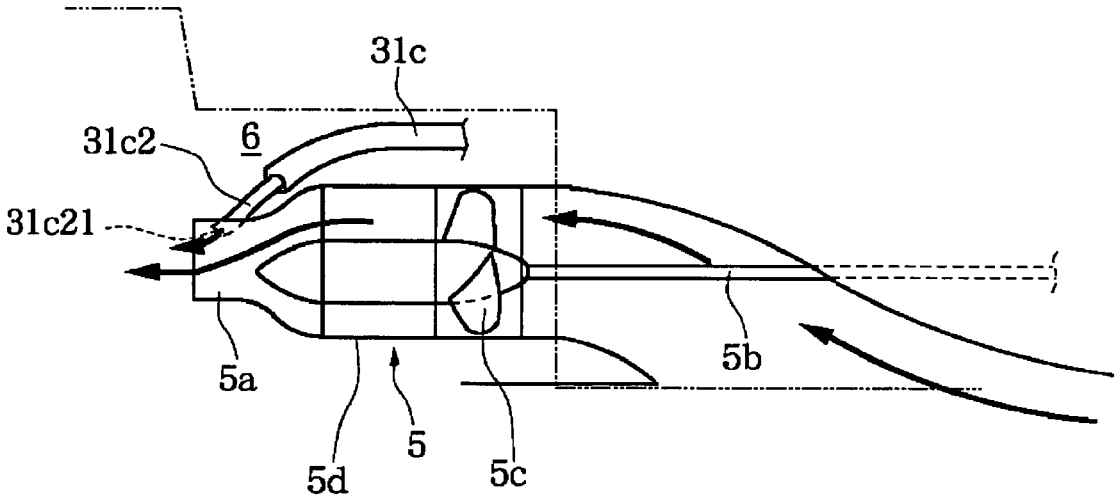
FIG. 8 is a schematic side elevational view of a portion of the drainage assembly illustrated in FIG. 7.

Another modification of the watercraft 1 is shown in FIGS. 6–8. FIG. 6 is a rear view of the watercraft. FIG. 7 is a perspective view showing a drainage assembly. FIG. 8 is a side view showing the arrangement that a water outlet portion of the drainage assembly is provided on the nozzle of the jet propulsion device.

The watercraft 1 shown in FIGS. 6–8 can be constructed similarly to the embodiment shown in FIGS. 1–4, except that it is provided with a drainage assembly 31 configured to draw water accumulated in the recessed area 3*a* out of the watercraft body 4 by way of a drainage conduit 30 provided at the bottom of the recessed area 3*a*1.

The drainage assembly 31 can be constituted with at least one or a pair of removal hoses 31*a*, 31*b*, drain hose 31*c*, and water storage 31*d*. One end 31*a*1 or 31*b*1 on each of a pair of removal hoses 31*a*, 31*b* is connected to the drainage conduit 30, and the other end 31*a*2 or 31*b*2 on each of the pair of removing hoses 31*a*, 31*b* is connected to the water storage 31*d*. In addition, one end 31*c*1 of the drain hose 31*c* can be connected to the water storage 31*d*, and the other end 31*c*2 of the drain hose 31*c* can be connected to the nozzle 5*a* of the jet propulsion device 5.

A drive shaft 5*b* rotates by the driving force of the jet propulsion device 5. An impeller 5*c* rotates in conjunction with the drive shaft 5*b*. The incoming water flow from the bottom of the watercraft body 4 is pressurized by the impeller 5*c*, regulated by a stator blade section 5*d*, and at the same time narrowed down by the nozzle 5*a*. Then the water jets out as a high speed flux.

With reference to FIG. 8, because the incoming water flow from the bottom of the watercraft is jetted out as a high sped flux from the nozzle 5*a*, and because a drain opening 31*c*21 of the drain hose 31*c* is slantingly projected into the nozzle 5*a*, vacuum pressure is exerted on the drain hose 31*c*. As such, water from the recessed area 3*a* can be drawn into the nozzle 5*a* and ejected rearwardly therefrom.

During operation, the recessed area 3*a* on the deck 3 can accumulate water due to water spray coming into the watercraft operation, or after washing down the watercraft body on land. In such cases, the water accumulated in the recessed area 3*a* is drawn out through the drain hose 31*c*, the water storage 31*d*, and the pair of removing hoses 31*a* and 31*b*, and is drained from the drain opening 31*c*21 of the drain hose 31*c*. The water storage 31*d* may be a box type or a pipe joint type. Provision of a check valve in the middle of the pair of removing hoses 31*a* and 31*b* can assure more positive water drainage.

In addition, in the arrangement that the foot rest member 25 is fitted into the recessed area 3*a* of the deck 3, and that the operator sits on the seat 20 and runs on water operating the steering handlebars 10, one end 31*a*1 or 31*b*1 on each of the pair of removing hoses 31*a* and 31*b* can help secure the foot rest member 25 onto the recessed area 3*a* of the deck 3 via the drainage conduit 30 making use of the vacuum pressure. Thus, there is no need to provide separate securing means.

Figure 9:
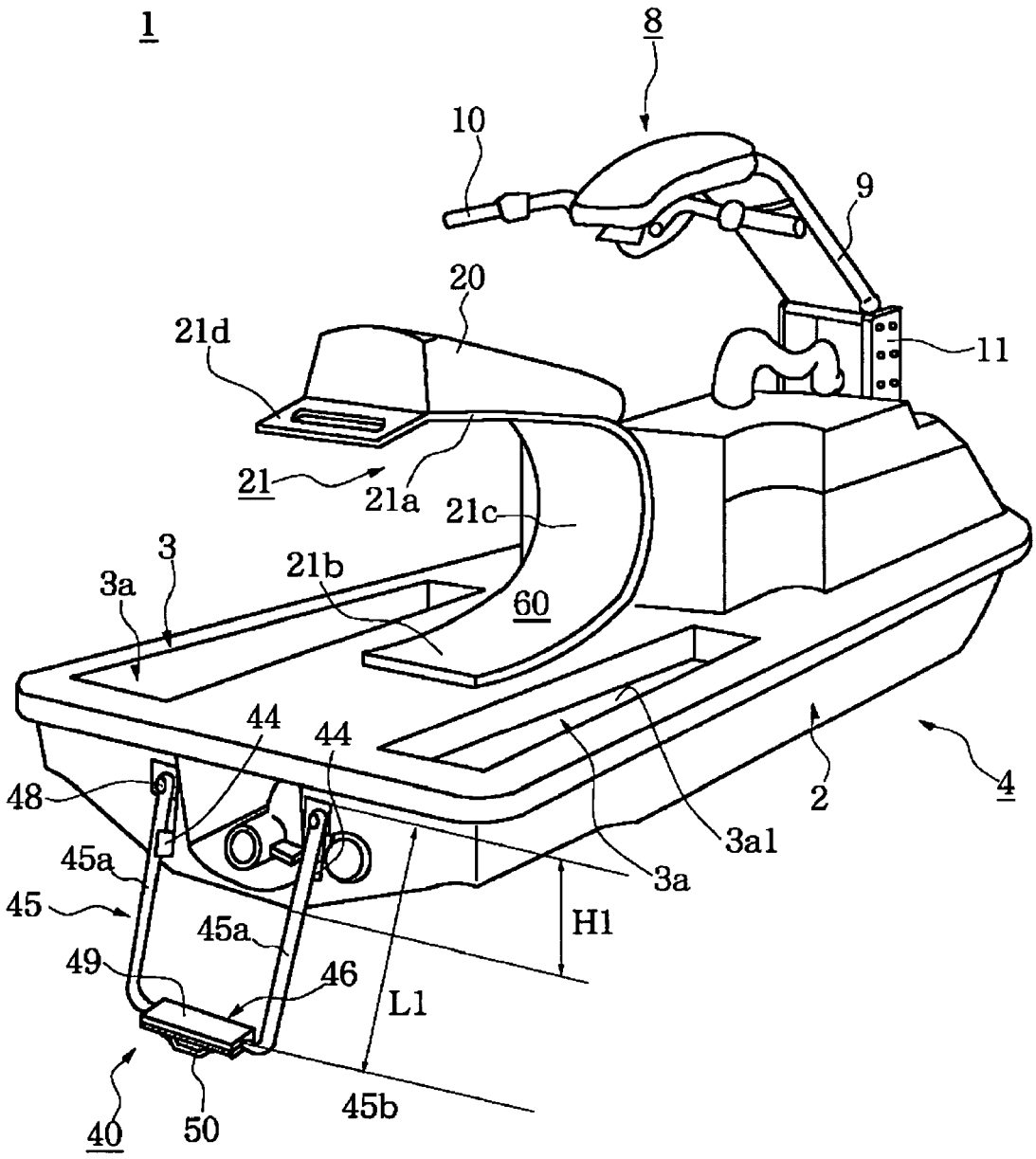
FIG. 9 is a perspective view of another modification of the watercraft of FIG. 1, including a step ladder.
Figure 10:
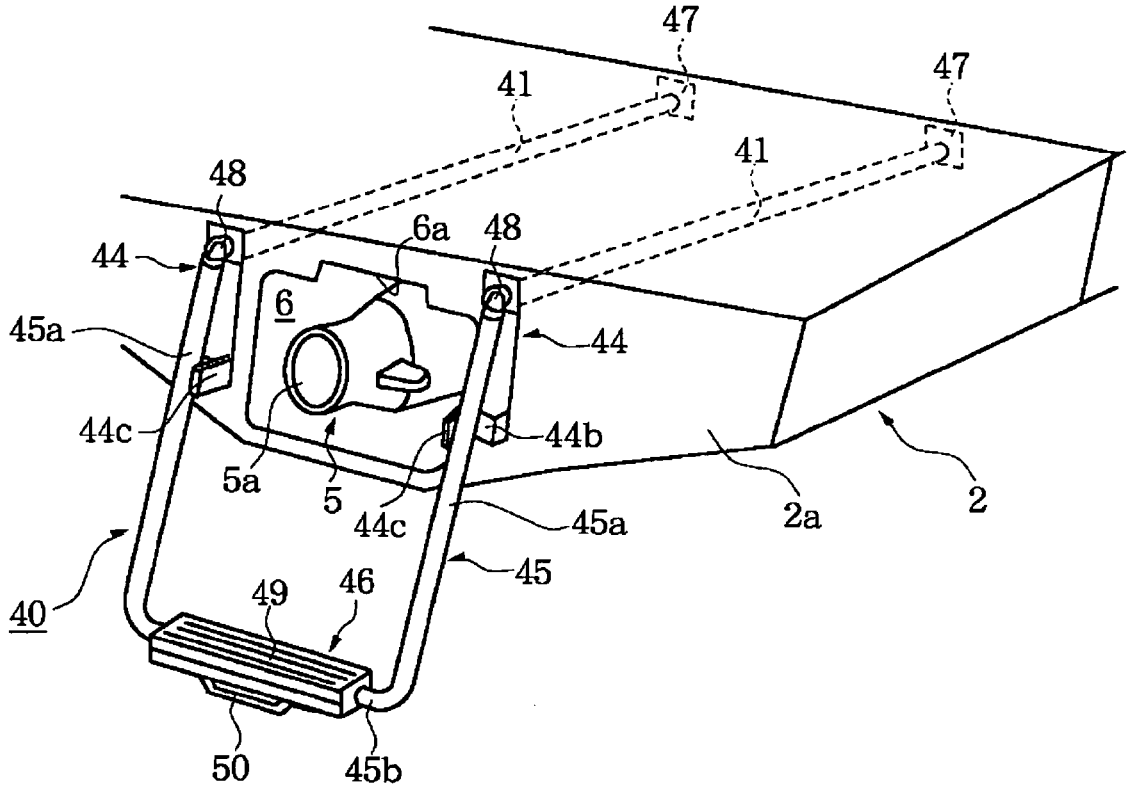
FIG. 10 is an enlarged perspective view of the mounting area of the step ladder shown in FIG. 9.
Figure 11:
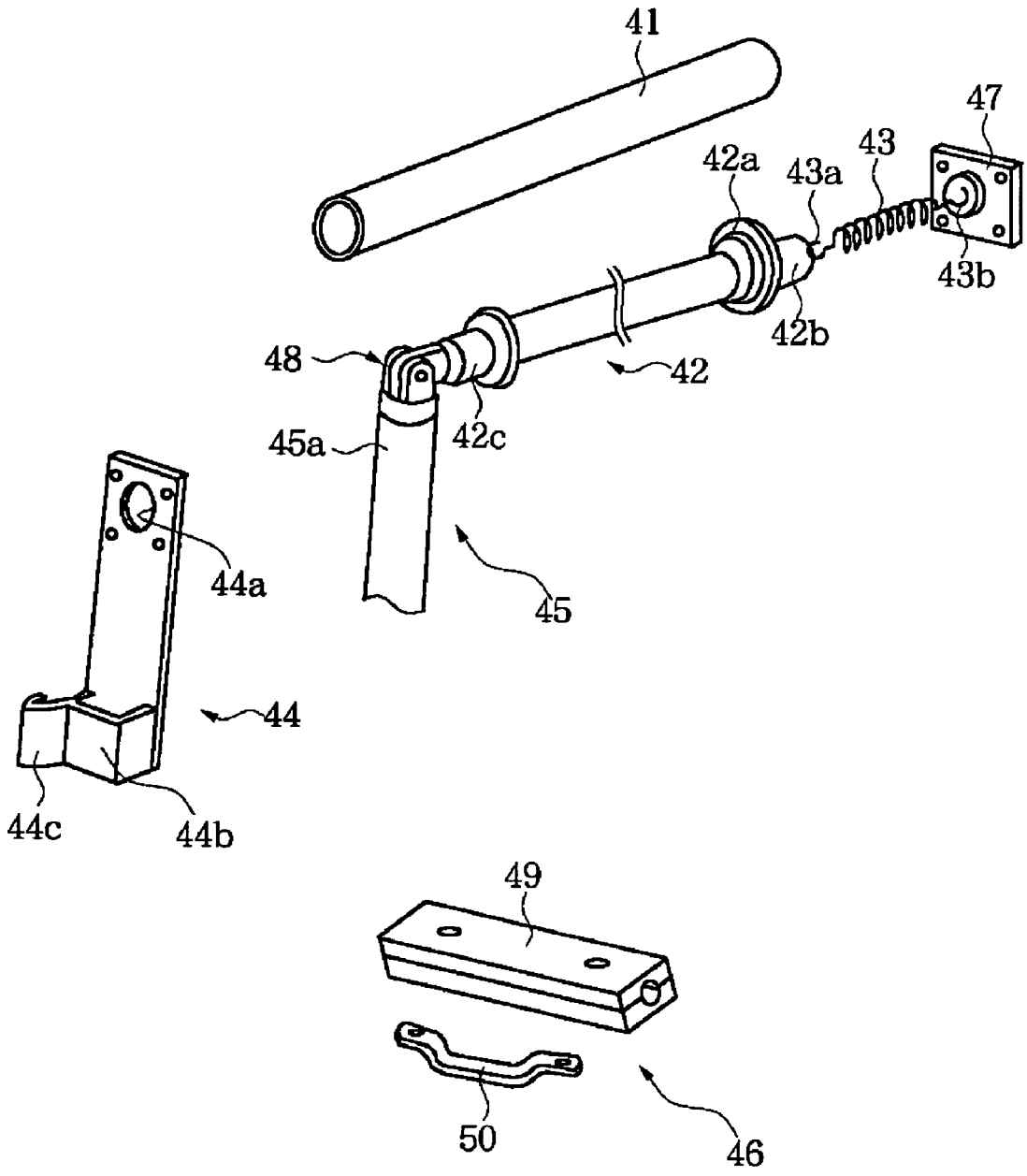
FIG. 11 is an exploded perspective view of the step ladder mounting area shown in FIG. 10.

As shown in FIGS. 9–11, the watercraft 1 can be provided with a pull-out retractable step ladder 40. FIG. 9 is a perspective view of the watercraft 1 equipped with the step ladder 40. FIG. 10 is an enlarged view of the step ladder mounting area. FIG. 11 is an exploded perspective view of the step ladder mounting area.

The step ladder 40, according to this embodiment, can be constituted with a pair of supporting pipes 41, a pair of sliders 42, a pair of springs 43, a pair of holding plates 44, a step supporting pipe 45, a step 46, and other parts.

The pair of supporting pipes 41 can be arranged in parallel within the watercraft body 4 in a fore-to-aft direction. The pair of supporting pipes 41 can be located on both sides above the jet propulsion device 5. The pair of sliders 42 can be accommodated slidably in the pair of supporting pipes 41, with a collar portion 42*a* formed at both ends of the sliders 42 to assure the smooth sliding.

One end 43*a* of the spring 43 can be attached to one end 42*b* of the pair of sliders 42. The other end 43*b* of the spring 43 can be attached to a fastener 47, that can be metal, on the watercraft body 4. The other end 42*c* of the pair of sliders 42 can be connected to the both ends 45*a* of the step holding pipe 45 formed into a "U" shape by means of the joint coupling pin 48. The step 49 can be mounted at a center portion 45*b* of the step holding pipe 45. A handlebar 50 can also be secured to the step 49.

As the step holding pipe 45 is pulled out, both of the end areas 45*a* of the step holding pipe 45 are retained by the pair of holding plates 44. The pair of holding plates 44 can be attached to the rear wall 2*a* of the hull 2. Additionally, an inserting eye hole 44*a*, a slantingly holding portion 44*b*, and a positioning portion 44*c* can also be provided on each of the holding plates 44.

In normal running condition, the step rudder 40 is not an obstacle for the running watercraft. Rather, both of the end areas 45*a* can be inserted into the inserting eye holes 44*a* of the holding plates 44, and be received by the pair of supporting pipes 41, with a pair of sliders 42 guiding the end areas 45*a* into the supporting pipes 41. The end areas 45*a* can be retained within the supporting pipes 41 by a pair of springs 43. In a fully retracted position, the step 49 of the step holding pipe 45 can be abutted against the rear wall 2*a* of the hull 2.

When the operator in the water wishes to climb aboard the watercraft body 4, the operator can pull out the handlebar 50. As the handlebar 50 is pulled out, both of the end areas 45*a* of the step holding pipes 45 are pulled out of the supporting pipes 41 against the force of the pair of springs 43, and with the pair of sliders 42 guiding the end areas 45*a* of the supporting pipes 41. After the end areas 45*a* have been withdrawn from the supporting pipes such that the supporting pin 48 is pulled out beyond the holes 44*a*, the end areas 45*a* can be pivoted downwardly around the joint coupling pin 48.

While the step holding pipe 45 is pulled out, the operator can place one of his or her legs on the step 46 to climb up on board. As shown in FIG. 9, both of the end areas 45*a* of the step holding pipe 45 are formed to have a length L1 that is generally about twice as long as the hull height H1 of the hull 2. Thus, the step 46 is located relatively deep in water, making it easier for the operator to place his or her feet on the step 46 and to climb onboard.

When the operator climbs on board, both of the end areas 45*a* of the step holding pipe 45 are abutted against the slantingly holding portion 44*b* and the positioning portion 44*c* of the pair of holding plates 44. Thus, as shown in FIG. 10, they are positively kept in the slanted position to facilitate the climbing action.

After the operator climbs onboard, the step holding pipe 45 and the step 46 are raised by the force of the propulsion o the watercraft 1 and the spring force of the spring 43, and both of the end areas 45*a* of the step holding pipe 45 can be automatically retracted into the pair of supporting pipes 41 under the restoring force of the springs 43.

Constructing at least one part of the step ladder 40, such as the step holding pipe 45 or step 46 for instance, with buoyancy material, the buoyancy of the material can make retraction of the step rudder 40 easier. For example, at least one of the step holding pipe 45, the step 46, and another portion of the ladder 40 from a material that has sufficient buoyancy to float on water can help the retraction process.

Figure 12:
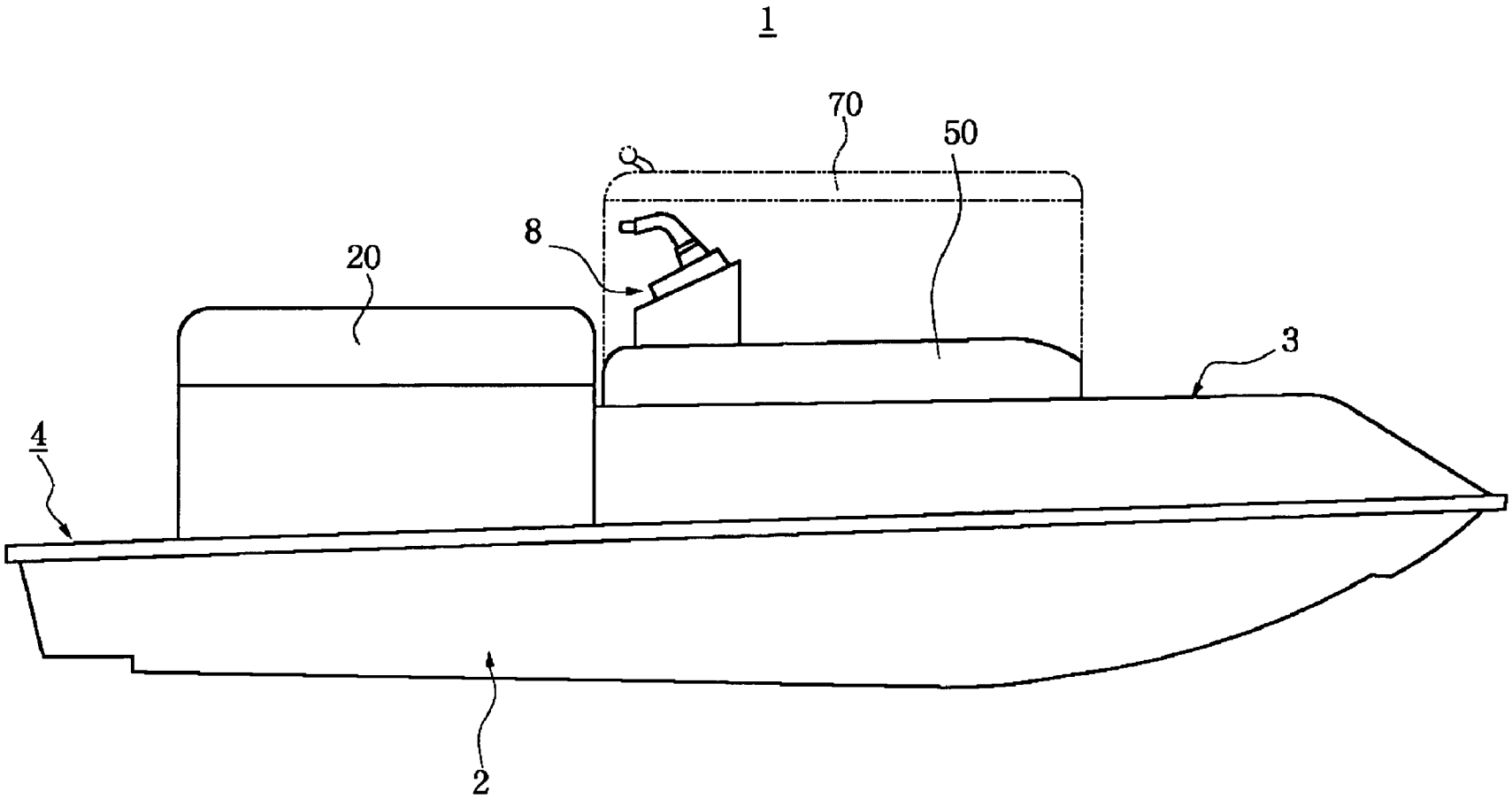
FIG. 12 is a side elevational view of another modification of the watercraft of FIG. 1 in which a handlebar supporting base stand is opened and closed laterally, the closed position shown in solid line and an opened position shown in phantom line.
Figure 13:
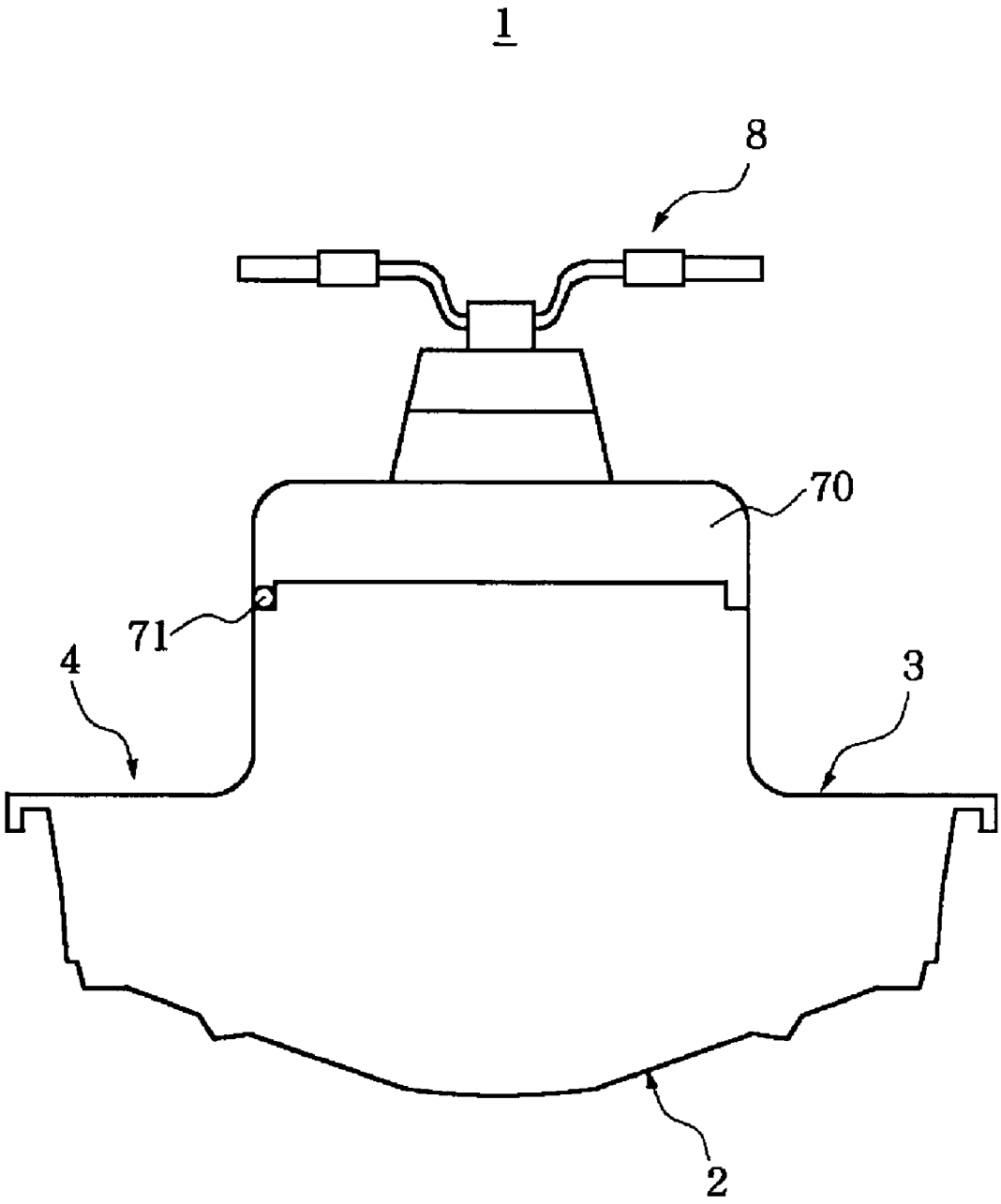
FIG. 13 is a rear elevational view of the watercraft shown in FIG. 12.
Figure 14:
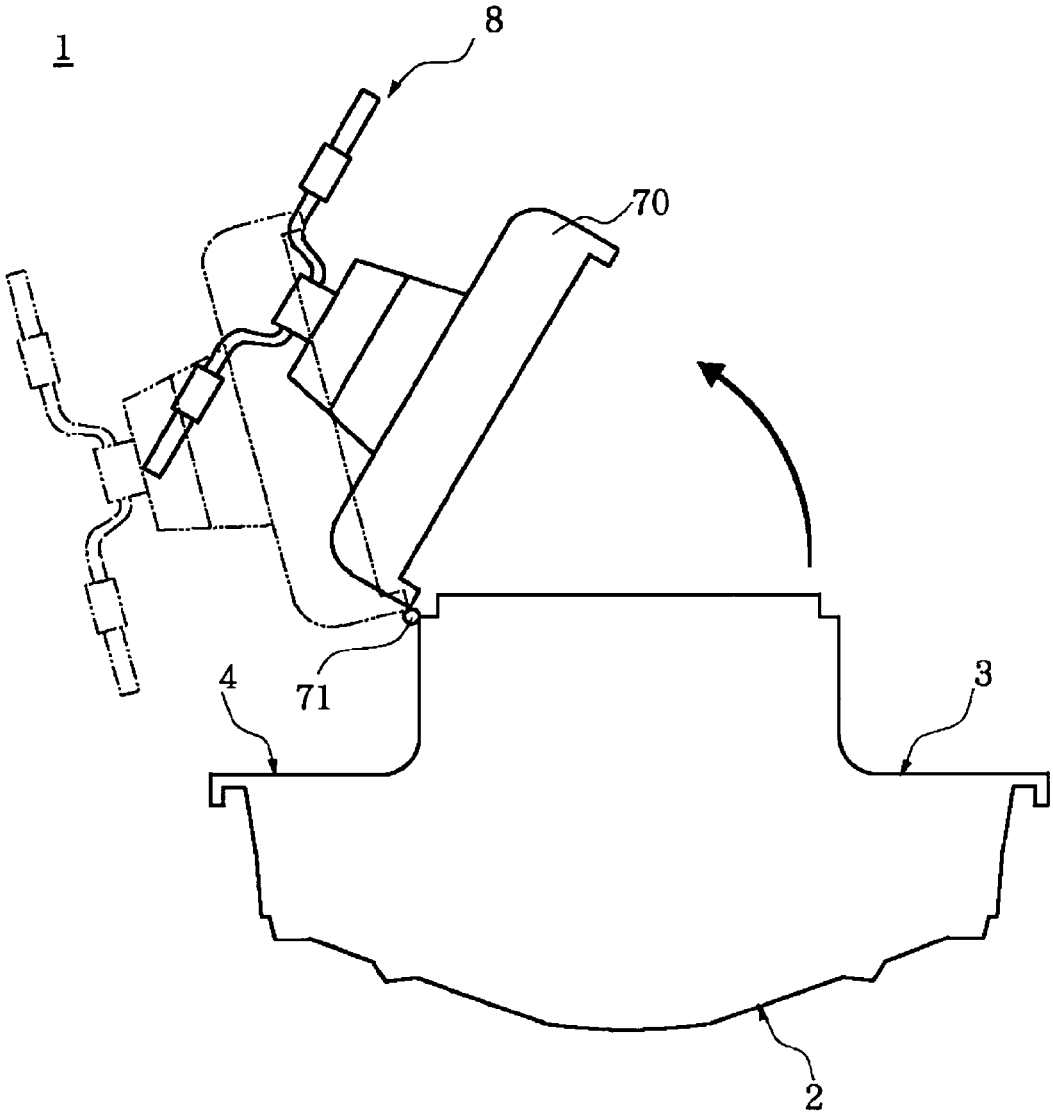
FIG. 14 is another rear elevational view of the watercraft of FIG. 12 showing the handlebar supporting base in a partially opened position in solid line and a fully opened position in phantom line.

Another modification of the watercraft 1 is illustrated in FIGS. 12–14. FIG. 12 is a side view of the modified watercraft 1. FIG. 13 is a rear view of the modified watercraft 1. FIG. 14 is a rear view showing how a handlebar supporting base stand of the modified watercraft 1 is opened and closed.

On this watercraft 1, a hinge 71 can be provided on one side of the handlebar supporting base stand 70 on which a steering handlebar 8 is secured, so as to allow the handlebar supporting base stand 70 to open and close along a lateral edge thereof.

A moment of inertia of the base stand 70 can be smaller when the base stand 70 is laterally opened and closed as compared with that resulting from a base stand that is opened and closed about a hinge disposed on a forward edge. Thus, the illustrated base stand 70 can be opened and closed more easily, with improved operability and simplified construction. Also, the handlebar supporting base stand 70 can have 180 degrees opening angle as shown in FIG. 14 to enable engine mounting and dismounting without removing the handlebar supporting base stand 70 for engine maintenance and so on.

Although the present inventions have been disclosed in the context of certain preferred embodiments, features, aspects, and examples, it will be understood by those skilled in the art that the present inventions extend beyond the specifically disclosed embodiments to other alternative embodiments and/or uses and obvious modifications and equivalents thereof. In addition, while a number of variations have been shown and described in detail, other modifications, which are within the scope of the present inventions, will be readily apparent to those of skill in the art based upon this disclosure. It is also contemplated that various combinations or subcombinations of the specific features and aspects of the embodiments may be made and still fall within the scope of the present inventions. Accordingly, it should be understood that various features and aspects of the disclosed embodiments can be combined with or substituted for one another in order to form varying modes of the present inventions. Thus, it is intended that the scope of the present inventions herein disclosed should not be limited by the particular disclosed embodiments described above.

What is claimed is:

1. A watercraft comprising a lower hull, a deck, a straddle-type seat, a supporting member configured to support the seat on the deck, a steering handlebar bar disposed in front of the seat, a space formed between the seat and the deck directly underneath the seat, extending approximately over the entire length of the seat in fore-and-aft direction of the watercraft, wherein the supporting member has an upper portion secured to the seat, a lower portion secured to the deck, and an intermediate portion connecting the upper portion and the lower portion, and wherein the intermediate portion is provided at either the front end or the rear end of the seat, the watercraft additionally comprising foot rest members installed on both lateral sides of the seat and having a predetermined height configured to be freely attachable and detachable from the deck, wherein upwardly-facing parts of the deck surface are configured to receive the foot rest members, the upwardly-facing parts being disposed lower position than a top wall of a tunnel formed on a lower portion of the lower hull.

2. The watercraft according to claim 1, wherein the upwardly-facing parts of the deck define recessed areas, the watercraft further comprising a drainage assembly configured to draw water accumulated in the recessed areas out of a watercraft body with a drainage conduit connected to a bottom of the recessed areas.

3. A watercraft comprising a lower hull, a deck, a straddle-type seat, a steering handlebar bar disposed in front of the seat, upwardly-facing parts of the deck defining first and second recessed foot areas, a drainage assembly configured to draw water accumulated in the first and second recessed foot areas out of the watercraft with a drainage conduit connected to a bottom of the recessed areas, and a first water drain opening into the first recessed foot area and a second drain opening into the second recessed foot area, the first and second drains communicating with the drainage conduit, wherein the drainage conduit comprises a first conduit connected to the first drain, a second conduit connected to the second drain, the first and second conduit also being connected to a water storage device.

4. The watercraft according to claim 3 additionally comprising first and second foot rest members disposed in the first and second recessed foot areas, respectively, the first and second foot rest members having a predetermined height configured to be freely attachable and detachable from the deck.

5. The watercraft according to claim 3 additionally comprising a jet pump configured to generate thrust for moving the watercraft, and third conduit connecting the water storage device to the jet pump such that when the jet pump operates, the jet pump draws water from the water storage device and discharges the water rearwardly relative to the watercraft.

6. The watercraft according to claim 5 additionally comprising a check valve disposed along the third conduit.

7. A watercraft comprising a lower hull, a deck, a straddle-type seat, a steering handlebar bar disposed in front of the seat, upwardly-facing parts of the deck defining first and second recessed foot areas, and a drainage assembly configured to draw water accumulated in the first and second recessed foot areas out of the watercraft with a drainage conduit connected to a bottom of the recessed areas, wherein the drainage conduit includes an outlet end, the watercraft additionally comprising a check valve disposed in the drainage conduit upstream from the outlet end.

* * * * *

UNITED STATES PATENT AND TRADEMARK OFFICE

CERTIFICATE OF CORRECTION

PATENT NO. : 7,188,573 B2
APPLICATION NO. : 11/085913
DATED : March 13, 2007
INVENTOR(S) : Yoshiki Hirabara It is certified that error appears in the above-identified patent and that said Letters Patent is hereby corrected as shown below:

At column 1, line 45, please delete "pose" and insert -- impose --, therefor.

Signed and Sealed this

Twenty-seventh Day of November, 2007

JON W. DUDAS
*Director of the United States Patent and Trademark Office*